US012480654B2

(12) United States Patent
Oglesbee et al.

(10) Patent No.: US 12,480,654 B2
(45) Date of Patent: Nov. 25, 2025

(54) SYSTEMS AND METHODS FOR CONTROLLING A HEAT TRANSFER SYSTEM

(71) Applicant: Rheem Manufacturing Company, Atlanta, GA (US)

(72) Inventors: Robert Oglesbee, Fishers, IN (US); Allen A. Thorn, Hearne, TX (US); Stephen Maciulewicz, Montgomery, AL (US); Christopher M. Puranen, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 906 days.

(21) Appl. No.: 17/010,230

(22) Filed: Sep. 2, 2020

(65) Prior Publication Data

US 2022/0065450 A1 Mar. 3, 2022

(51) Int. Cl.
*F23N 5/02* (2006.01)

(52) U.S. Cl.
CPC ..... *F23N 5/025* (2013.01); *F23N 5/022* (2013.01); *F23N 2229/14* (2020.01)

(58) Field of Classification Search
CPC ..... F23N 2229/12; F23N 2229/14; F23N 5/022; F23N 5/025
See application file for complete search history.

(56) References Cited

U.S. PATENT DOCUMENTS 4,823,114 A * 4/1989 Gotisar ..... F23N 5/242 431/24
5,472,336 A * 12/1995 Adams ..... F23N 5/123 431/2
5,548,277 A * 8/1996 Wild ..... F23N 5/082 340/579
2012/0288806 A1* 11/2012 Racaj ..... F23N 5/123 431/18
2015/0348393 A1* 12/2015 Margolin ..... G08B 17/125 340/577
2016/0172997 A1* 6/2016 Andris ..... H05K 7/1432 363/71

OTHER PUBLICATIONS

Impacts of Power Grid Frequency Deviation on Time Error of Synchronous Electric Clock and Worldwide Power System Practices on Time Error Correction, Aug. 2017 (Year: 2017).*

* cited by examiner

*Primary Examiner* — Schyler S Sanks
(74) *Attorney, Agent, or Firm* — Eversheds Sutherland (US) LLP

(57) ABSTRACT

A flame sensing system, a flame sensing unit, and a method for sensing a flame are described. The flame sensing system includes a flame sense probe and a power regulating device. The power regulating device is configured to generate a regulated voltage from an input voltage received from a power source and to output the regulated voltage to the flame sense probe such that a flame current along a flame can be measured. The flame sensing system also includes a flame current detector to measure the flame current and generate an output voltage corresponding to the flame current, and a first level detector to generate a flame strength output signal based on the output voltage, where the flame strength output signal is indicative of a strength of a flame.

20 Claims, 10 Drawing Sheets

SYSTEMS AND METHODS FOR CONTROLLING A HEAT TRANSFER SYSTEM

TECHNICAL FIELD

The present disclosure relates, in general, to detecting a flame and measuring a flame strength and, more specifically relates, to flame sense and flame strength detection for use in heating appliances.

BACKGROUND

Over the years, various types of flame sensing systems have been developed and employed for use in heating appliances, such as gas water heaters and gas furnaces. A conventional flame sensing system is typically used to detect the presence or absence of a flame in a heating appliance. Generally, the flame sensing systems are designed to detect failure or absence of the flame and to thereby identify and prevent potential leakage of gas. Conventional flame sensing systems can include a transformer, a flame detection circuit, and a flame sense probe. The flame sense probe is typically mounted in a path of the flame. The transformer can provide a high voltage to the flame detection circuit and a flame current for a conductivity provided by the flame. In operation, when the flame is lit, the flame sensing system detects a current (e.g., alternating current (AC)) conducted from the flame sense probe, through the flame, and back to ground. Based on the detected current, the flame sensing system generates a "go/no-go" signal. The "go/no-go" signal is merely indicative of the presence or absence of the flame. An action is then performed based on the "go/no-go" signal. For example, if no flame is detected by the flame sense probe, the flame may have to be reignited or the heating appliance may have to be shut down by terminating fuel flow in the heating appliance (e.g., to terminate a fuel leak). Further, the transformers used in the flame sensing systems are typically heavy and bulky low-frequency transformers that typically operate at 50 Hertz or 60 Hertz. Also, the low frequency transformers are typically expensive. Due to usage of low-frequency transformers that typically operate at 50 Hertz or 60 Hertz, the conventional flame sensing systems are generally slow-reacting systems, as a considerable amount of time is required by the flame sensing systems to sense the presence or absence of the flame. The time required for detecting the presence or absence of a flame can sometimes result in damage to the heating appliances and other objects. For example, a long response time in the event of flame absence can lead to undesired leakage of gas, which can result in fire hazards. Furthermore, the flame sensing systems typically have unregulated input power. Any variation/fluctuation in the input power can lead to inconsistency in the flame sense output signal generated by the flame sensing systems. Thus, the conventional flame sensing systems are typically bulky, slow, and expensive.

SUMMARY

The present disclosure includes a flame sensing system. The flame sensing system can include a flame sense probe and a power regulating device. The power regulating device can be electrically coupled to the flame sense probe and configured to generate a regulated voltage from an input voltage received from a power source and output the regulated voltage to the flame sense probe. The flame sensing system also includes a flame current detector electrically coupled to the power regulating device and the flame sense probe. The flame current detector can be configured to detect and/or measure a flame current and generate an output voltage corresponding to the flame current. The flame sensing system can include a first level detector electrically coupled to the flame current detector. The first level detector can be configured to generate a flame strength output signal based on the output voltage. The flame strength output signal can be indicative of a strength of a flame located proximate the flame sense probe.

The first level detector can be configured to generate the flame strength output signal based on comparison of the output voltage to a pre-determined strength threshold. The flame sensing system can include a second level detector configured to generate a flame presence output signal indicative of a presence or an absence of the flame proximate the flame sense probe. The flame sensing system can include a third level detector configured to generate a diagnostic output signal indicative of an operationality of the flame sensing system (e.g., whether the flame sensing system is operational and/or functioning correctly). The second level detector can be configured to generate the flame presence output signal based on comparison of the output voltage to a pre-determined presence threshold. Further, the third level detector can be configured to generate the diagnostic output signal based on comparison of the output voltage to a pre-determined diagnostic threshold. The diagnostic output signal can be indicative of the operationality of flame sensing system.

The flame sensing system can include a processor electrically coupled to the first level detector, the second level detector, and/or the third level detector. The processor can be configured to receive the flame strength output signal, the flame presence output signal, and/or the diagnostic output signal, and can be configured to monitor a change in the flame current, a change in the flame strength output signal, a change in the flame presence output signal, and/or a change in the diagnostic output signal. The processor can be configured to generate a digital output indicative of working condition of the flame sensing device and/or a flame status indicative of the strength of the flame. The flame sensing system can include a display unit electrically coupled to the processor and configured to display the digital output.

The flame sensing system can include a peak detector configured to generate an analog secondary flame strength output signal. The analog secondary flame strength output signal can provide an analog indication of the strength of the flame. The power regulating device can include a rectifier and a regulated inverter configured to generate the regulated voltage from the input voltage received from the power source and to output the regulated voltage.

The present disclosure can include a flame sensing unit that includes a flame sense probe and a flame sensing device. The flame sensing device can include a power regulating device electrically coupled to the flame sense probe and the power regulating device can be configured to generate a regulated voltage from an input voltage received from a power source and output the regulated voltage to the flame sense probe. The flame sensing device can include a flame current detector electrically coupled to the power regulating device and the flame sense probe. The flame current detector can be configured to detect a flame current from the flame sense probe and generate an output voltage corresponding to the flame current. The flame sensing device can include a first level detector electrically coupled to the flame current detector and configured to generate a flame strength output signal based on the output voltage. The flame sensing unit can include a processor electrically coupled to the first level detector, and the process can be configured to receive the flame strength output signal and generate an output indicative of a strength of a flame located proximate the flame sense probe.

The first level detector can be configured to generate the flame strength output signal based on comparison of the output voltage to a pre-determined strength threshold. The flame sensing unit can include a second level detector configured to generate a flame presence output signal indicative of a presence or an absence of the flame and/or can include a third level detector configured to generate a diagnostic output signal indicative of an operationality of flame sensing unit. The second level detector can be configured to generate the flame presence output signal based on comparison of the output voltage to a pre-determined presence threshold. The third level detector can be configured to generate the diagnostic output signal based on comparison of the output voltage to a pre-determined diagnostic threshold. The flame sensing unit can include a peak detector to generate an analog secondary flame strength output signal, where the analog secondary flame strength output signal provides an analog indication of a strength of the flame. The power regulating device can include a rectifier and a regulated inverter to generate the regulated voltage and to output the regulated voltage.

According to the present disclosure, a method of sensing a flame is disclosed. The method can include generating, by a power regulating device, a regulated voltage from an input voltage received from a power source and can include providing the regulated voltage to a flame current detector. The method can include providing the regulated voltage to a flame sense probe such that a flame current along a flame can be measured, the flame being proximate the flame sense probe. The method can include detecting and/or measuring, by the flame current detector, the flame current from the flame sense probe and generating, by the flame current detector, an output voltage corresponding to the flame current. Further, the method can include generating, by a first level detector, a flame strength output signal based on the output voltage, where the flame strength output signal is indicative of a strength of the flame. The flame strength output signal can be generated based on comparison of the output voltage to a pre-determined strength threshold.

The method can include identifying, by the flame current detector, a change in the flame current indicative of a change in the strength of the flame. The output voltage can correspond to the change in the flame current. The method can include generating, by a second level detector, a flame presence output signal based on comparison of the output voltage to a pre-determined presence threshold, where the flame presence output signal is indicative of a presence or an absence of the flame at the flame sense probe. Further, the method can include generating, by a third level detector, a diagnostic output signal based on comparison of the output voltage to a pre-determined diagnostic threshold, where the diagnostic output signal is indicative an operationality of a flame sensing system. The method can include generating, by a peak level detector, an analog secondary flame strength output signal from the output voltage, where the analog secondary flame strength output signal provides an analog indication of the strength of the flame.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of the present disclosure (including alternatives and/or variations thereof) can be obtained with reference to the Detailed Description along with the following drawings, in which.

DETAILED DESCRIPTION

Figure 1:
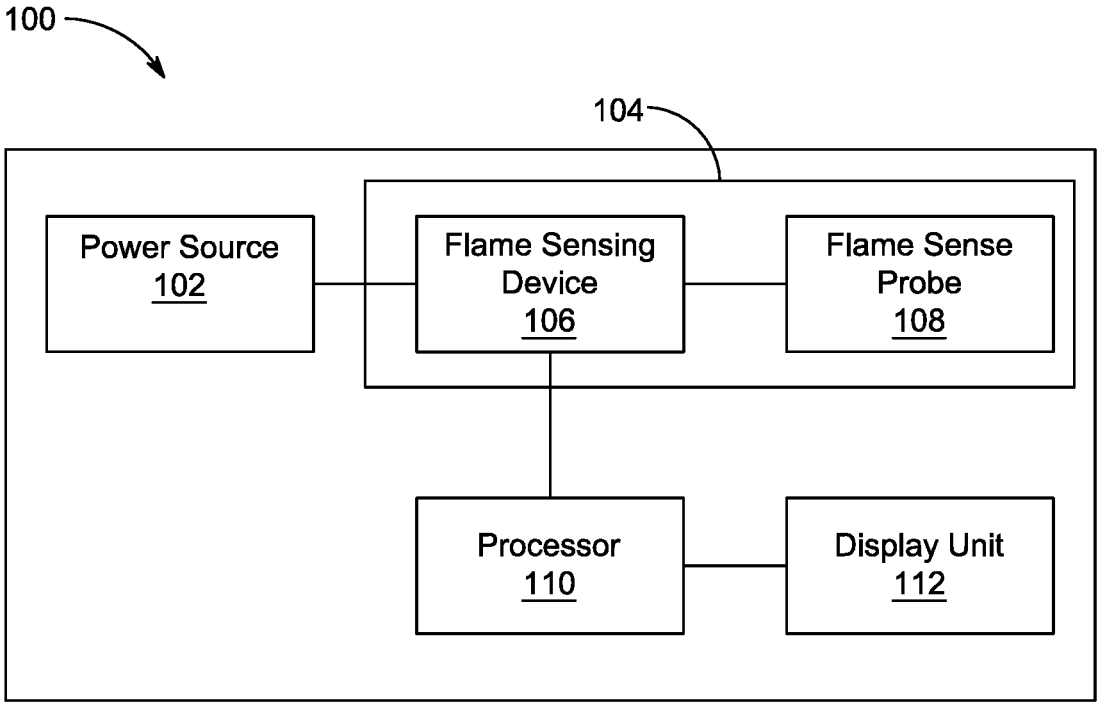
FIG. 1 is a block diagram of a flame sensing system.

FIG. 1 is a block diagram illustrating a flame sensing system 100. The flame sensing system 100 can be a part of or supportive of a gas combustion control circuitry for use in heating appliances, such as gas water heaters and gas furnaces. The flame sensing system 100 can detect or sense a flame and can detect or measure flame strength of the flame in a heating appliance. The flame sensing system 100 can be configured to control a heat transfer system.

The flame sensing system 100 can include a power source 102, a flame sensing unit 104 including a flame sensing device 106 and a flame sense probe 108, a processor 110, and a display unit 112. The power source 102 can be electrically coupled to the flame sensing unit 104 and the processor 110. Further, the processor 110 can be electrically coupled to the display unit 112. As an example, the processor 110 can be or include a microprocessor or a microcontroller.

The power source 102 can be configured to supply input power to the flame sensing unit 104. The power source 102 can supply 24 Volt Alternating Current (AC) or 120 Volt AC. The flame sense probe 108 can be strategically mounted in a path of a flame such that slightest of flame comes in contact with the flame sense probe 108. The flame sensing device 106 can be configured to generate a regulated voltage from an input voltage received from the power source 102. The flame sensing device 106 can be configured to output the regulated voltage to the flame sense probe 108 such that a flame current along a flame can be measured, the flame being proximate the flame sense probe 108.

The flame sensing device 106 can be configured to measure the flame current and generate an output voltage corresponding to the flame current. Further, in response to the flame current, the flame sensing device 106 can be configured to determine whether there has been a change in flame status. The flame sensing device 106 can generate the output voltage in a form of one or more dynamic signals. The dynamic signals can be understood as pulsating signals having rising and falling edges. The one or more dynamic signals can be indicative of flame status (i.e., whether or not there is a flame and strength of the flame) and/or whether the flame sensing device 106 is functioning correctly. As an example, the flame sensing device 106 can generate a square wave. The presence of the square wave and pulse percentage of the square wave can be an indication of the flame, strength of the flame, and/or operating condition of the flame sensing device 106. Alternatively or additionally, the flame sensing device 106 can be configured to generate a sinusoidal signal or other type of signals for use in detection of the flame and/or measurement of strength of the flame.

The processor 110 can be configured to receive the one or more dynamic signals and monitor a change in the flame current and/or a change in each of the one or more dynamic signals. The processor 110 can then generate a digital output indicative of a working condition of the flame sensing device 106 and/or the flame status, which is indicative of the strength of the flame. Further, the display unit 112 can be configured to display the digital output. For example, the processor 110 can display (e.g., via the display unit 112) the digital output indicative of the flame status, the strength of the flame, and/or the operating condition of the flame sensing device 106. The digital output can be in a form of a number, and/or a graphical characterization of the flame or flame strength (e.g., color coding, various icons). A visual alarm can be displayed on the display unit 112 to indicate start/stop of the flame, increase in the flame, decrease in the flame, abrupt changes in flame, and the like.

In addition, the processor 110 can be connected to other hardware peripherals such as alarm devices such as speakers, sirens, or horns to alert professionals of changes in status and/or strength of the flame. The processor 110, through the peripheral device, can produce an alarm sound to alert an operator of a heating appliance (in which the flame sensing system 100 can be implemented) in case of potential combustion problems or flame out. Alternatively or additionally, the processor 110 can send a message and/or a visual alert to the operator of the heating appliance on his or her mobile device to alert the operator in case the flame goes out or the flame sensing device 106 stops functioning as desired. Other methods and examples of alerting the operator of the heating appliance are contemplated herein. The processor 110 can be coupled to a gas control unit (not shown) to control the flow of gas to have desired levels of the flame. Based on the heating requirements, the processor 110 can control the gas control unit using the inputs from the flame sensing unit 104.

Although, it has been described that the processor 110 and the display unit 112 are implemented external to the flame sensing unit 104, the processor 110 and the display unit 112 can be implemented within the flame sensing unit 104. Further, the flame sensing device 106 can be a hard-wired device, an Integrated Circuit (IC) or a circuit that is constructed using various electronic components such as transistors, resistor, capacitors, diodes, etc. or a combination thereof. The manner in which the flame sense and flame strength detection is performed by the flame sensing system 100 is explained in greater detail in conjunction with FIG. 2.

Figure 2:
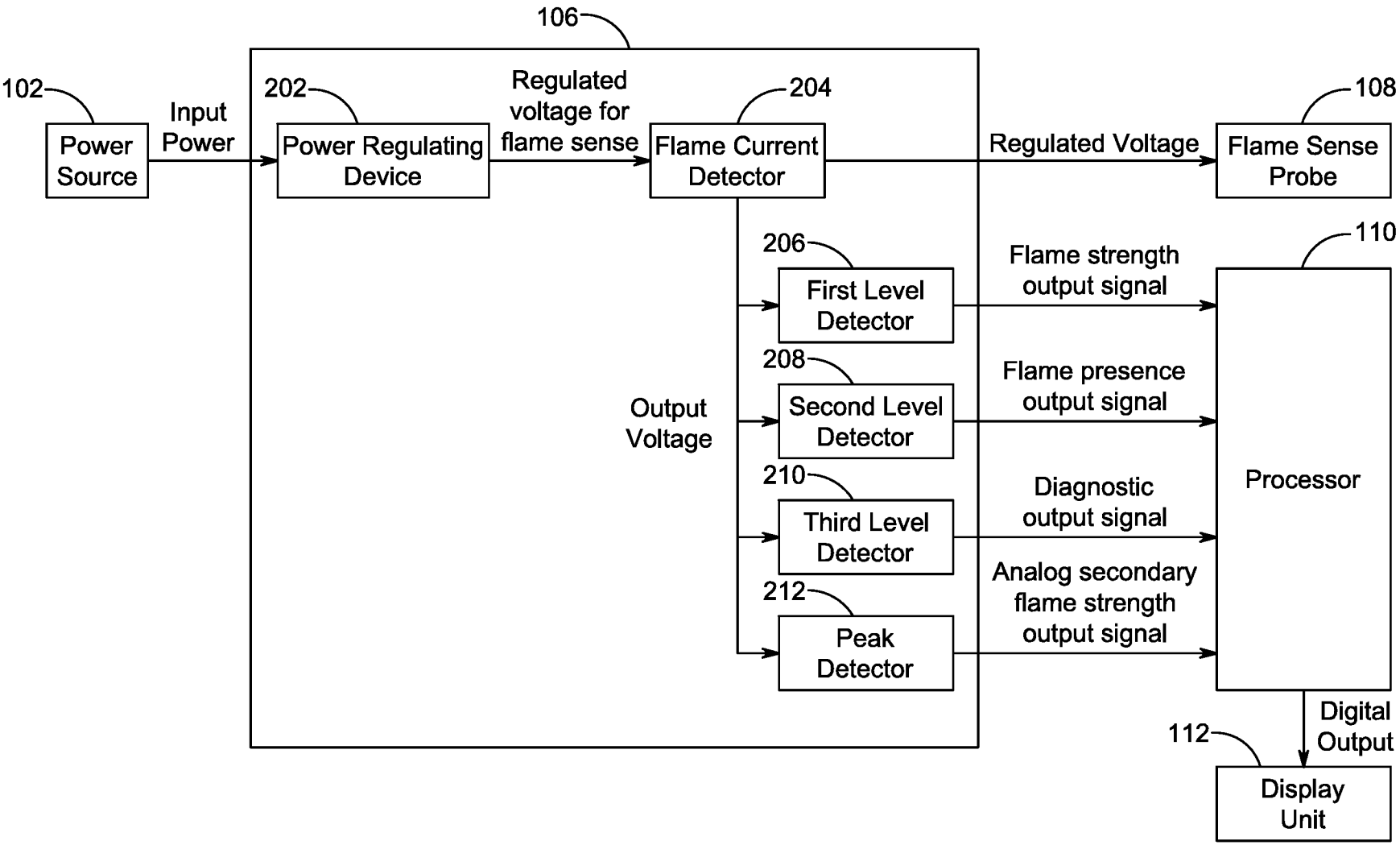
FIG. 2 is a detailed illustration of flame sense and flame strength detection by the flame sensing system.

FIG. 2 is a detailed illustration of flame sense and flame strength detection by the flame sensing system 100. As described above, the flame sensing system 100 can include the power source 102, the flame sensing unit 104 including the flame sensing device 106 and the flame sense probe 108, the processor 110, and the display unit 112. For example, the flame sense probe 108 can be mounted in a path of the flame. The flame sensing device 106 can include a power regulating device 202 (e.g., power regulating device), a flame current detector 204, a first level detector 206, a second level detector 208, a third level detector 210, and a peak detector 212. The power regulating device 202 can include a rectifier/filter and can include a regulated inverter. The regulated inverter can include a high frequency transformer. As an example, the high frequency transformer can be a discrete implementation of a push-pull switching transformer.

The flame current detector 204 can be electrically coupled to the first level detector 206, the second level detector 208, the third level detector 210, and the peak detector 212. Further, the first level detector 206, the second level detector 208, the third level detector 210, and the peak detector 212 can be electrically coupled to the processor 110. Further, the processor 110 can be electrically coupled to the display unit 112.

In operation, the power source 102 can be configured to provide input power to the flame sensing unit 104. The power regulating device 202 of the flame sensing device 106 can receive the input power from the power source 102. The power source 102 can be configured to supply 24 Volt AC line signal or 120 Volt AC line signal, for example, depending on the design of the flame sensing device 106. The power regulating device 202 can be configured to generate a regulated voltage from an input voltage received from the power source 102. In an example, the power regulating device 202 can generate a regulated voltage AC. As described above, the power regulating device 202 can include a rectifier/filter and a regulated inverter. The rectifier of the power regulating device 202 can be configured to convert the AC line signal into a regulated low voltage DC signal. Using the regulated low voltage DC signal, the regulated inverter of the power regulating device 202 can be configured to generate regulated high voltage AC signal of high frequency for flame sensing. Since the regulated inverter runs from the regulated DC signal, the output signal (i.e. the regulated high voltage) of the inverter can be stable and immune to fluctuations or variations in the input power. For example, the power regulating device 202 can operate at higher frequency than the conventional flame sense systems. For example, the power regulating device 202 can generate 120 Volt AC 500 Hertz output signal for the flame detection and the flame strength detection. Alternatively or additionally, the power regulating device 202 can generate a different voltage and frequency based upon what is optimal for a given system. However, the operational frequency can be set higher for faster detection of flame and/or detection of the strength of flame.

Further, the power regulating device 202 can output the regulated voltage to the flame sense probe 108 such that a flame current along a flame can be measured, with the flame being proximate to the flame sense probe 108. The flame sense probe 108 can be shaped for sensing the flame efficiently. For example, the flame sense probe 108 can be shaped in cylindrical shape, cone shaped, flat circular shaped, and the like, depending on a type of a flame or a burner. Further, the flame sense probe 108 material can be designed as a sheet, a mesh, a rod, a wire(s) and the like, as appropriately for effective reception of the flame. In an example, the flame sense probe 108 can be made of any of a stainless-steel material, a tungsten material, a nichrome material, etc. When a flame is lit, the gas is burnt releasing ions (known as flame ionization). The flame with ions can come into contact with the flame sense probe 108. The flame comprising ions due to combustion of gas can cause a conduction due to ionization. In other words, the flame can act as a path for electric current to ground (not shown). The conduction causes a rectified AC current to be conducted from the flame sense probe 108, through the flame, and back to ground. Also, the flame can have a high resistance and can thus act as a load for the flame sensing device 106.

The flame current can flow from the flame sense probe 108, through the flame, and to ground. Due to size of the flame sense probe 108 and the high resistance offered by the flame, the current can flow in one direction, resulting in rectification of the AC current and leading to a pulsating DC signal. The resulting pulsating DC signal can be considered as being rectified.

The flame current detector 204 can be configured to measure and/or detect the flame current from the flame sense probe 108 and generate an output voltage corresponding to the flame current. The flame current detector 204 can provide the output voltage as a function of the flame current. In response to any change in the flame current due to change in flame levels, the flame current detector 204 can provide the output voltage corresponding to the flame current. As an example, a stronger flame can correspond to a lower output voltage from the flame current detector 204, and a weaker flame can correspond to a higher output voltage from the flame current detector 204. In other words, when the flame is stronger, a stronger path (higher conductivity) can be formed by ions, leading to higher current flow through the flame, and thus leading to a lower output voltage. Conversely, when the flame is weaker, a weaker or less conductive path can be formed by ions, leading to lower current flow through the flame, and thus leading to a higher output voltage. The flame current detector 204 can provide the output voltage to the first level detector 206, the second level detector 208, the third level detector 210, and/or the peak detector 212. The first level detector 206, the second level detector 208, the third level detector 210, and/or the peak detector 212 can have different sensitivity characteristics (e.g., they have different circuitry and/or they show different levels of sensitivity to the output voltage). As a result, the first level detector 206, the second level detector 208, the third level detector 210, and the peak detector 212 can be configured read the output voltage differently.

The first level detector 206 can be configured to generate a flame strength output signal (also referred to as a flame condition output signal) based on the output voltage (e.g., received from the flame current detector 204). As an example, the first level detector 206 can generate the flame strength output signal based on peak detection, RMS (Root Mean Square) calculation, and/or duty cycle measurement. The flame strength output signal can be indicative of a strength of the flame, which can be located proximate the flame sense probe 108. The first level detector 206 can be configured to generate the flame strength output signal based on a comparison of the output voltage to a pre-determined strength threshold.

The second level detector 208 can be configured to provide a flame presence output signal indicative of a presence of the flame at the flame sense probe 108. The second level detector 208 can be configured to provide the flame presence output signal based on a comparison of the output voltage to a pre-determined presence threshold. For example, if the output voltage is equal to or less than the pre-determined presence threshold, it can be determined that the flame is present. Otherwise, if the output voltage is greater than the pre-determined presence threshold level, it can be determined that the flame is absent. Also, if the output voltage is lower than the pre-determined strength threshold and higher than the pre-determined presence threshold, then the output voltage indicates that the flame strength is minimum (i.e., the flame is a weak flame). As another example, if the output voltage is lower than both the pre-determined strength threshold and the pre-determined presence threshold, then it can be determined that the flame strength is strong. The pre-determined presence threshold can be set high to detect high output voltage due to weak or absence of the flame. The pre-determined presence threshold can be set such that the second level detector 208 can provide the flame presence output signal in response to a slightest presence/strength of the flame.

Although a single pre-determined strength threshold is described herein, more than one pre-determined strength threshold can be set for detecting the strength of the flame. For example, if the output voltage is less than or equal to a lowest pre-determined strength threshold, then the output voltage can indicate that the strength of the flame is maximum. If the output voltage is greater than the highest strength pre-determined strength threshold, then it can be determined that the strength of the flame is minimum or nil. The range of voltage output values between the highest and the lowest pre-determined strength thresholds can indicate different strengths of flame (e.g., corresponding to a scale of flame strength).

Further, the third level detector 210 can be configured to generate a diagnostic output signal indicative of an operationality of the flame sensing system 100. The diagnostic output signal can provide an indication that whether or not the flame sensing system 100 (or any component therein such as the flame sensing device 106 or the flame sense probe 108) is working properly or not. The third level detector 210 can be configured to generate the diagnostic output signal based on comparison of the output voltage to a pre-determined diagnostic threshold. As an example, the pre-determined diagnostic threshold can be set low such that the pre-determined diagnostic threshold can be used to determine if the flame sensing system 100 is functioning properly or not. For example, in case of loss of excitation of the power regulating device 202 (and in absence of the flame), the pre-determined diagnostic threshold can be used in determining that the power regulating device 202 is not functioning. For example, if the output voltage is greater than the pre-determined diagnostic threshold, then it can be determined that the flame sensing system 100 is functioning correctly. Conversely, if the output voltage is less than the pre-determined diagnostic threshold, then it can be determined that the flame sensing system 100 (or any component therein, for example the power regulating device 202) is not functioning correctly.

The flame strength output signal, the flame presence output signal, and the diagnostic output signal can be dynamic (pulsating) signals. Further, the peak detector 212 can be configured to generate an analog secondary flame strength output signal based on fast analog flame strength analysis. The analog secondary flame strength output signal may provide an analog indication of a maximum strength of the flame. The peak detector 212 may compare the output signal to a maximum signal threshold to identify and detect when the strength of the flame reaches maximum. The first level detector 206, the second level detector 208, the third level detector 210, and the peak detector 212 can have different sensitivity characteristics, i.e., they show different levels of sensitivity to the output voltage. As a result, the first level detector 206, the second level detector 208, the third level detector 210, and the peak detector 212 can read the output voltage differently. Accordingly, the first level detector 206, the second level detector 208, the third level detector 210, and the peak detector 212 can generate different output signals based on the analysis and processing of a single output voltage.

Although, it has been described that the flame sensing device 106 includes three level detectors, namely, the first level detector 206, the second level detector 208, and the third level detector 210, the flame sensing device 106 can include more or less than three level detectors for interpreting various other flame characteristics not described herein.

The processor 110 can be configured to receive the flame strength output signal, the flame presence output signal, the diagnostic output signal, and/or the analog secondary flame strength output signal. Further, the processor 110 can be configured to monitor a change in the flame current, a change in the flame strength output signal, a change in the flame presence output signal, a change in the diagnostic output signal, and/or a change in the analog secondary flame strength output signal. Based on the monitoring, the processor 110 can be configured to generate a digital output for the flame strength output signal, the flame presence output signal, the diagnostic output signal, and/or the analog secondary flame strength output signal. As an example, the digital output can be indicative of a working condition of the flame sensing device 106 and/or the flame status (i.e., flame absent, flame present, flame strength marginal, flame strength weak, or flame strength good). As an example, the digital output can be indicative of a strength of the flame. The processor 110 can then send the digital output to the display unit 112. The display unit 112 can be configured to display the digital output. The manner in which the digital output can be displayed on the display unit 112 is illustrated in following example figures. FIGS. 3-5 illustrate dynamic signals in the form of a square wave that can be generated by the first level detector 206, the second level detector 208, and/or the third level detector 210.

Figure 3A:
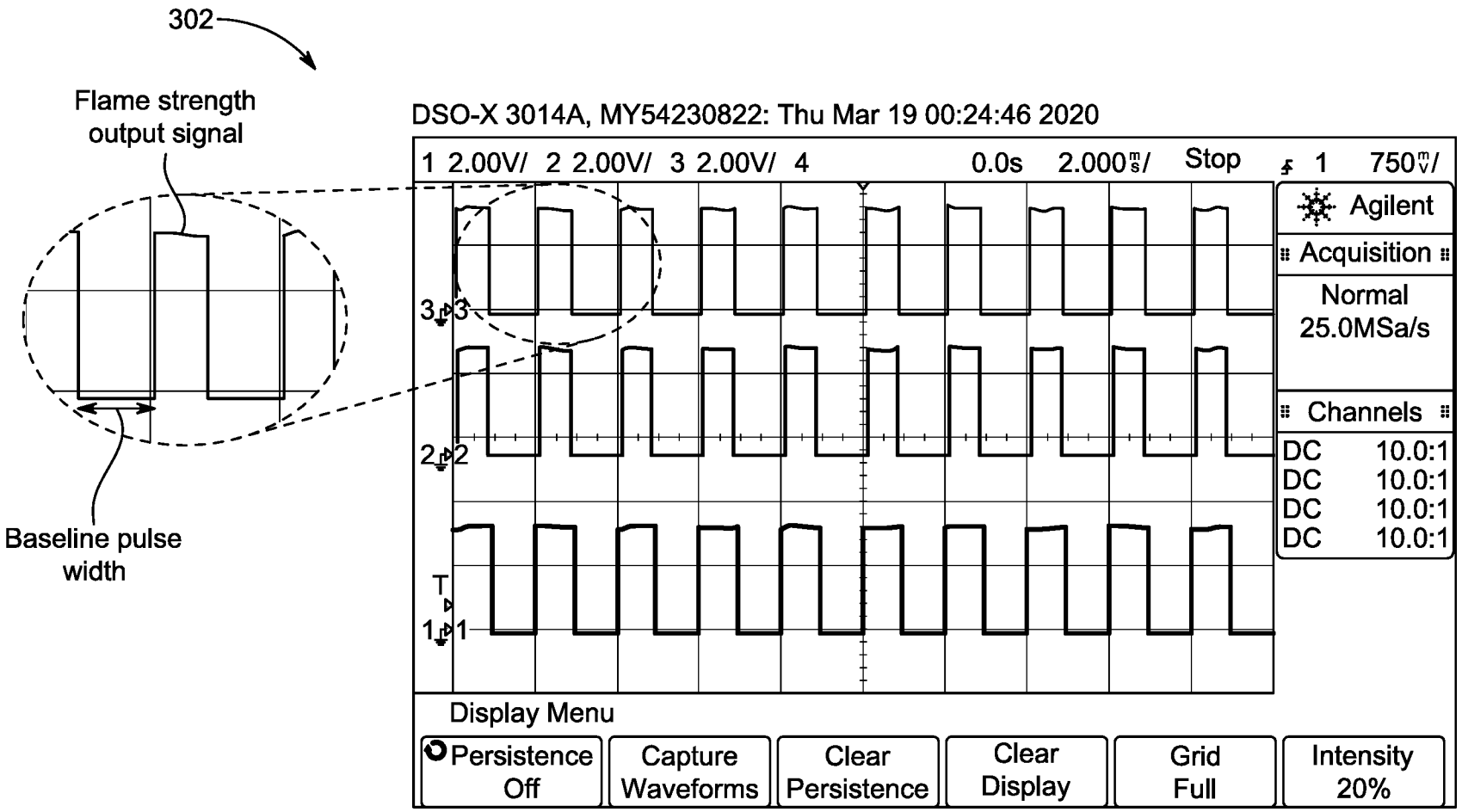
FIGS. 3A-3C show display of a flame strength output signal on a display unit of the flame sensing system.
Figure 3B:
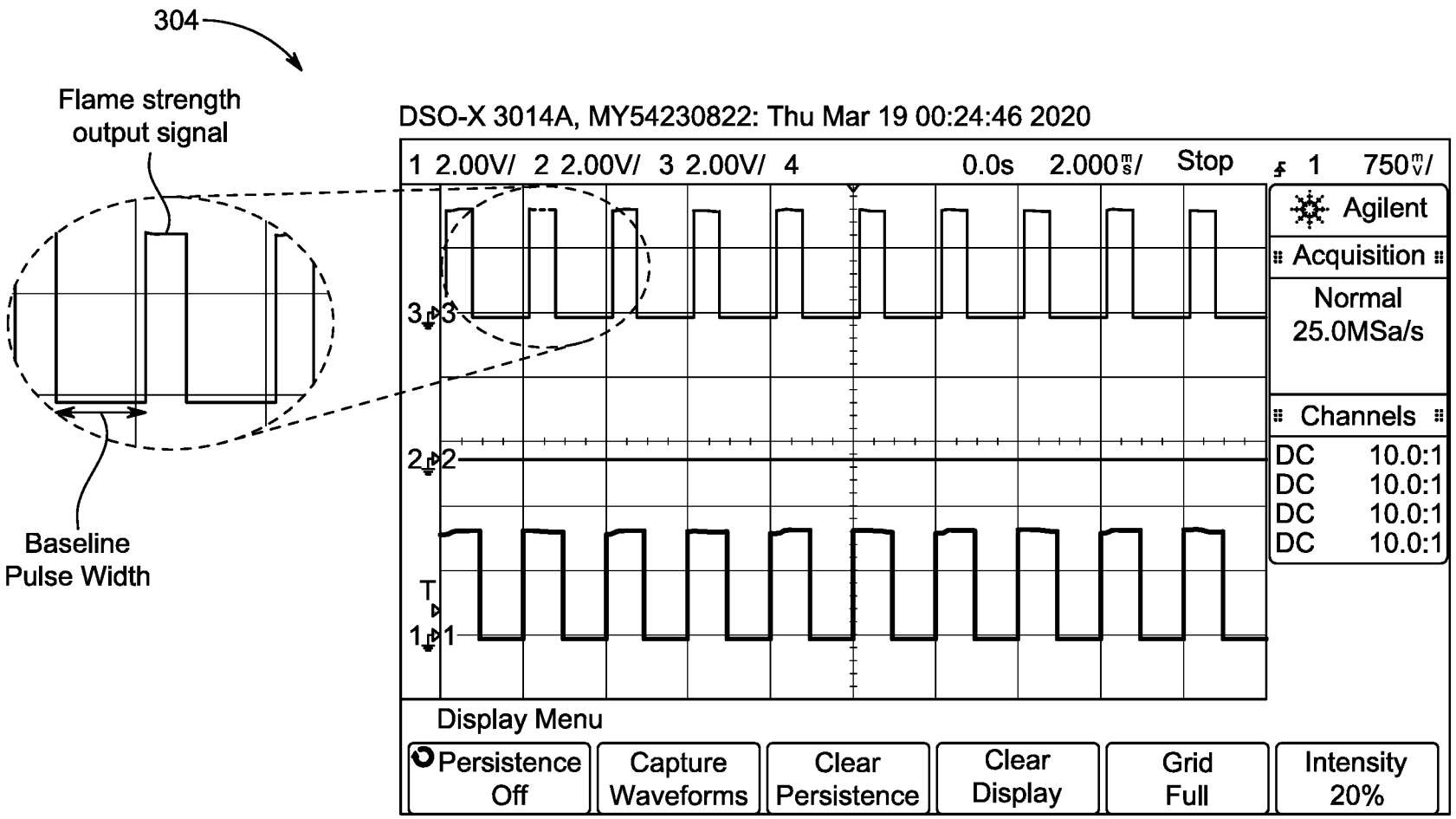
Figure 3C:
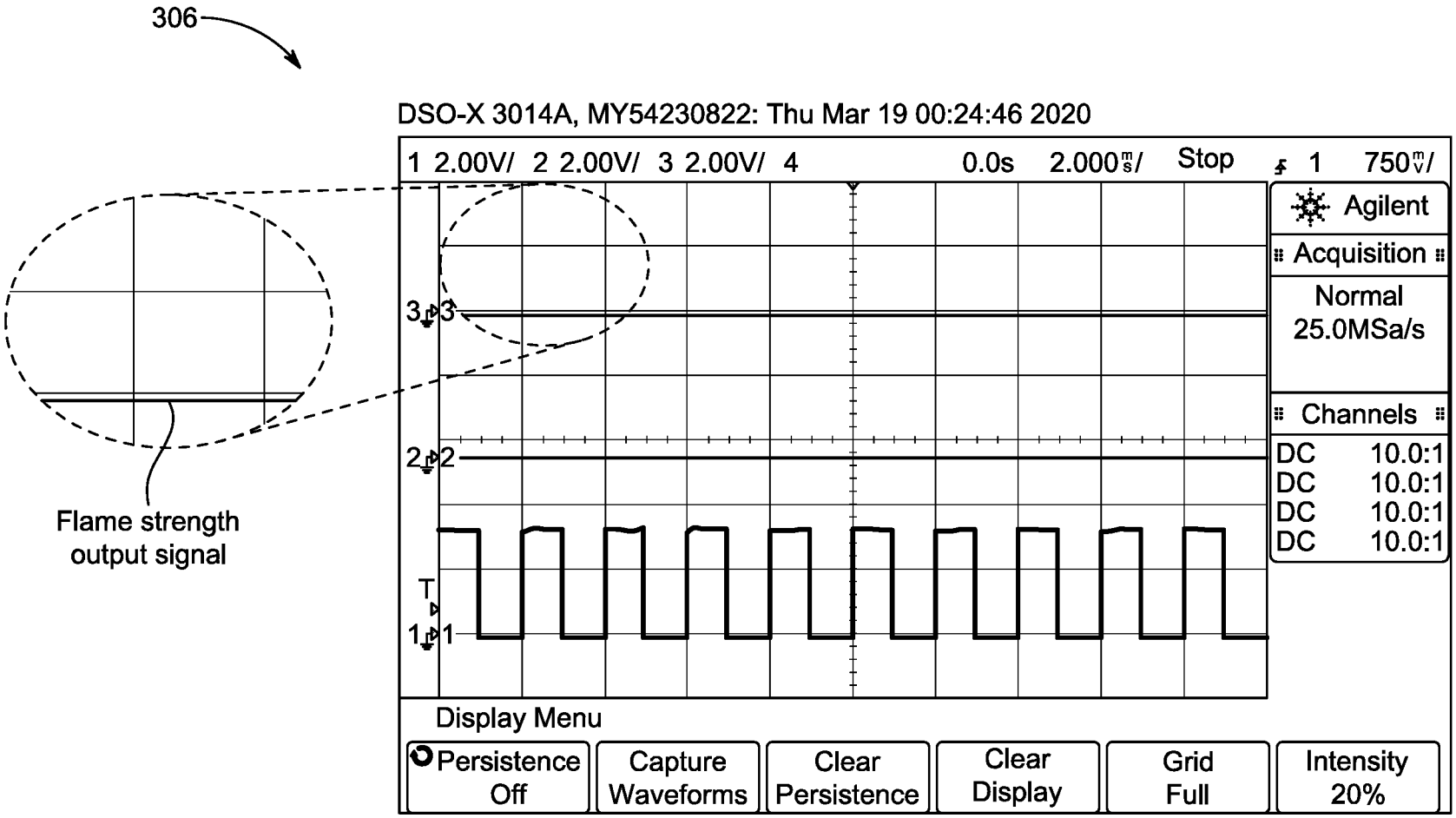

FIGS. 3A-3C show display of the flame strength output signal on the display unit 112 of the flame sensing system 100. FIG. 3A shows a display 302 of the flame strength output signal on the display unit 112 at normal operating conditions of the flame sensing system 100 in absence of the flame at the flame sense probe 108. As can be seen in FIG. 3A, the flame strength output signal can have a nominal baseline pulse width (for example, with 50% duty cycle) at normal operating conditions of the flame sensing system 100.

FIG. 3B shows a display 304 of the flame strength output signal on the display unit 112 at normal operating conditions of the flame sensing system 100 when strength of the flame is less than a maximum flame strength. As can be seen in FIG. 3B, the flame strength output signal can have an increased baseline pulse width (for example, 75% duty cycle) at normal operating conditions of the flame sensing system 100 when strength of the flame is less than a maximum flame strength. The baseline pulse width of the flame strength output signal can increase as a function of the flame strength.

FIG. 3C shows a display 306 of the flame strength output signal on the display unit 112 at normal operating conditions of the flame sensing system 100 when the strength of the flame is maximum. As can be seen in FIG. 3C, the flame strength output signal can have a flat baseline pulse width (100% duty cycle) at normal operating conditions of the flame sensing system 100 when the strength of the flame is maximum. The flame strength output signal having a flat baseline pulse width can be understood as a non-pulsating signal.

Figure 4A:
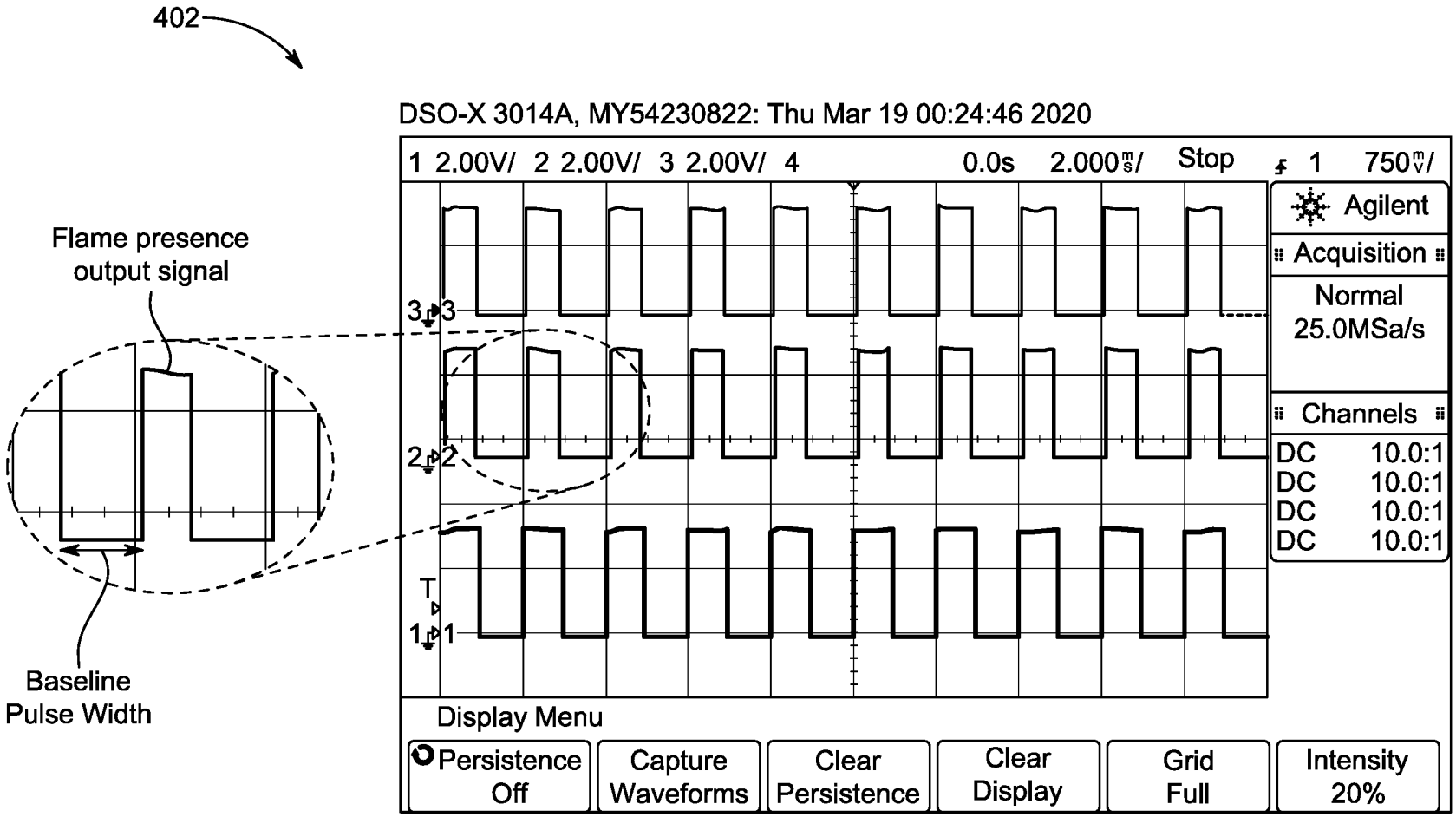
FIGS. 4A and 4B show display of a flame presence output signal on the display unit of the flame sensing system.
Figure 4B:
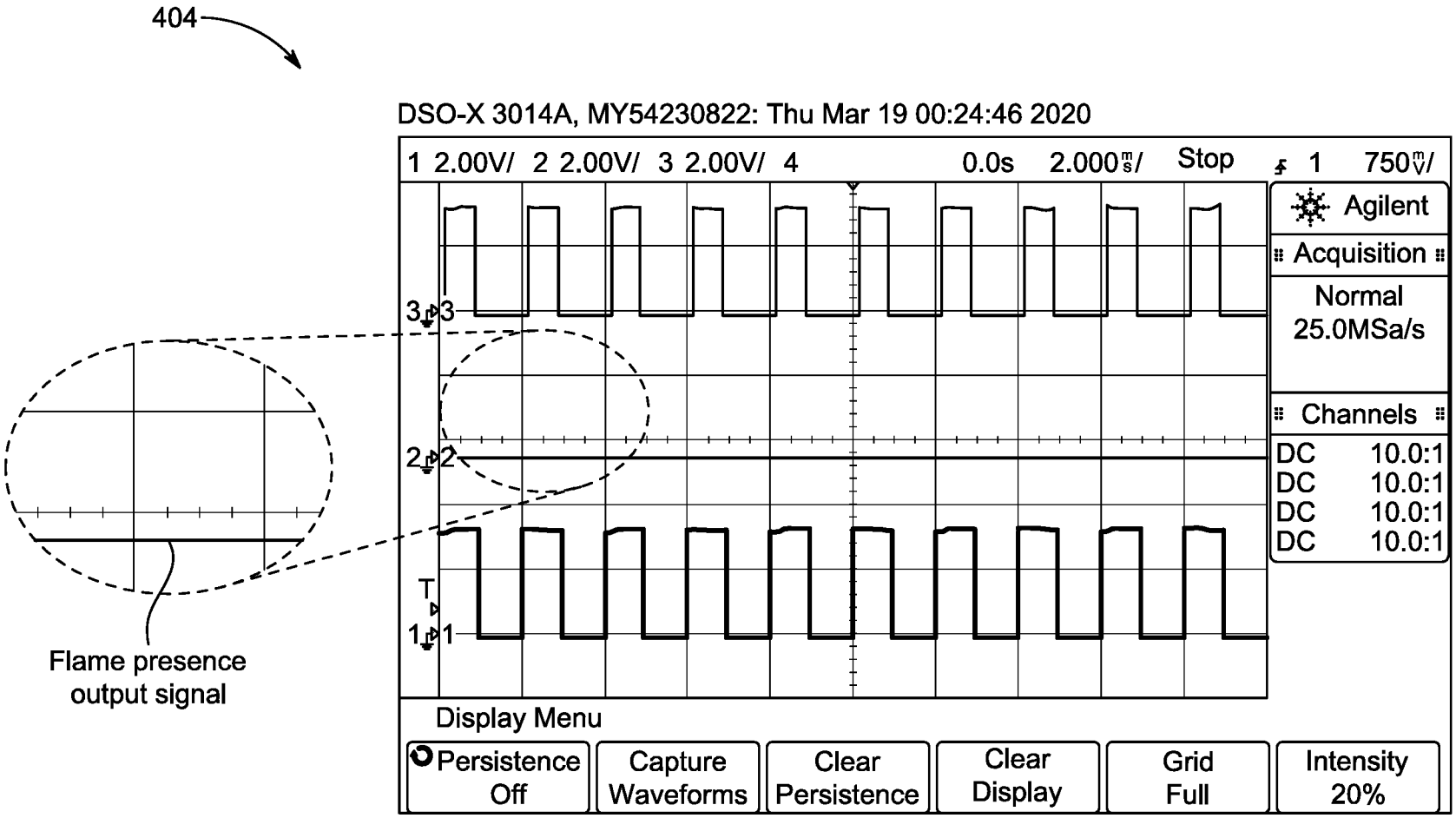

FIGS. 4A and 4B show display of the flame presence output signal on the display unit 112 of the flame sensing system 100. FIG. 4A shows a display 402 of the flame presence output signal on the display unit 112 at normal operating conditions of the flame sensing system 100 in absence of the flame at the flame sense probe 108. As can be seen in FIG. 4A, the flame presence output signal can have a nominal baseline pulse width (for example, 50% duty cycle) at normal operating conditions of the flame sensing system 100 in absence of the flame.

FIG. 4B shows a display 404 of the flame presence output signal on the display unit 112 at normal operating conditions of the flame sensing system 100 with presence (for example, minimum presence) of the flame at the flame sense probe 108. As can be seen in FIG. 4B, the flame presence output signal can have a flat baseline pulse width (for example, 100% duty cycle) at normal operating conditions of the flame sensing system 100 with presence of the flame at the flame sense probe 108. The flame presence output signal having a flat baseline pulse width can be understood as a non-pulsating signal.

Figure 5A:
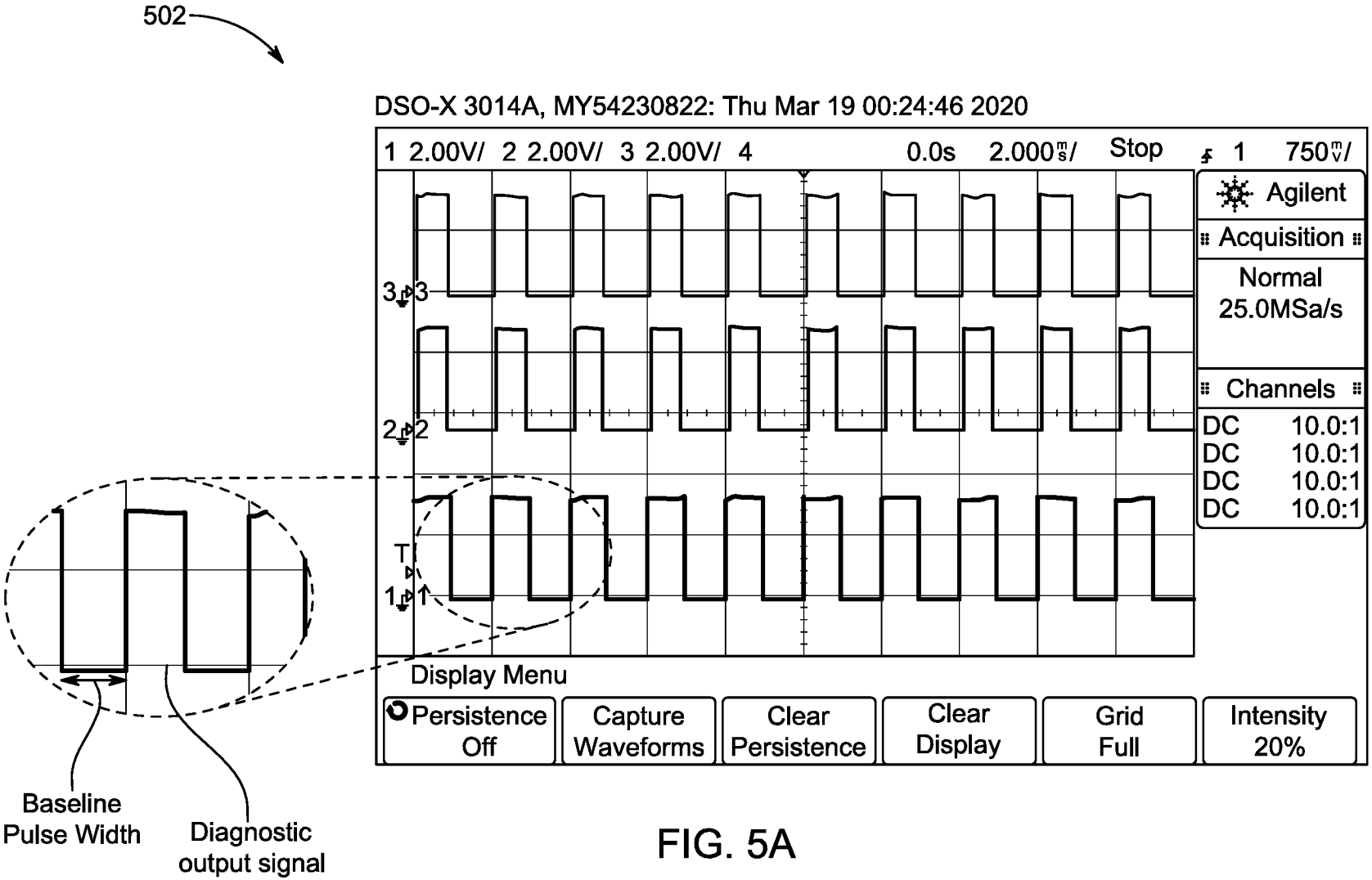
FIGS. 5A and 5B show display of a diagnostic output signal on the display unit of the flame sensing system.
Figure 5B:
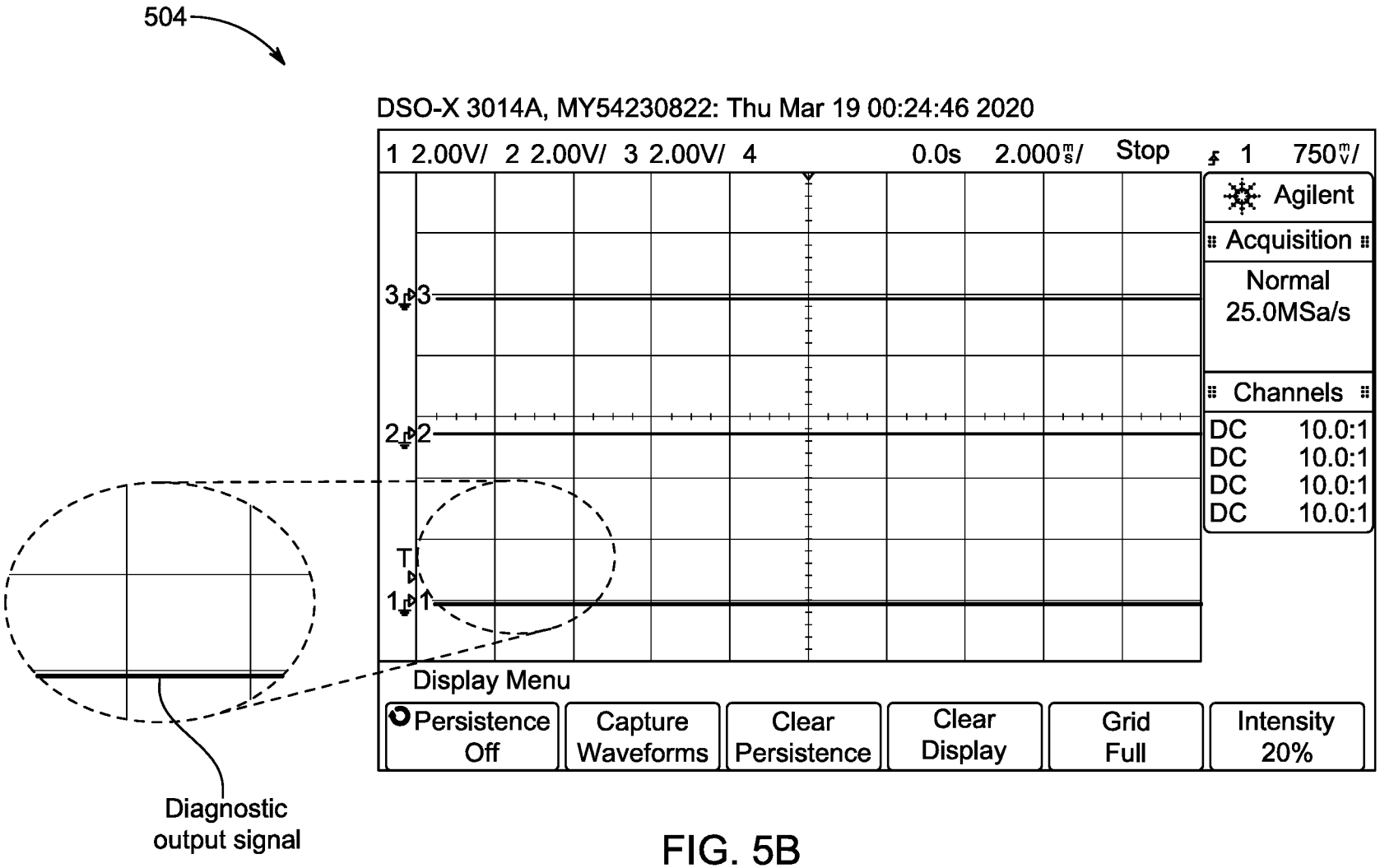

FIGS. 5A and 5B show display of the diagnostic output signal on the display unit 112 of the flame sensing system 100. FIG. 5A shows a display 502 of the diagnostic output signal on the display unit 112 at normal operating conditions of the flame sensing system 100 in absence of the flame at the flame sense probe 108. As can be seen in FIG. 5A, the diagnostic output signal can have a nominal baseline pulse width (for example, 50% duty cycle) at normal operating conditions of the flame sensing system 100 in absence of the flame.

FIG. 5B shows a display 504 of the diagnostic output signal on the display unit 112 in case of failure of any one of the power source 102, the flame sensing device 106, and the flame sense probe 108. As can be seen in FIG. 5B, the diagnostic output signal can have a flat baseline pulse width (for example, 100% duty cycle) in case of failure of any one of the power source 102, the flame sensing device 106 (or any component therein), and the flame sense probe 108. The diagnostic output signal having a flat baseline pulse width can be understood as a non-pulsating signal.

Figure 6:
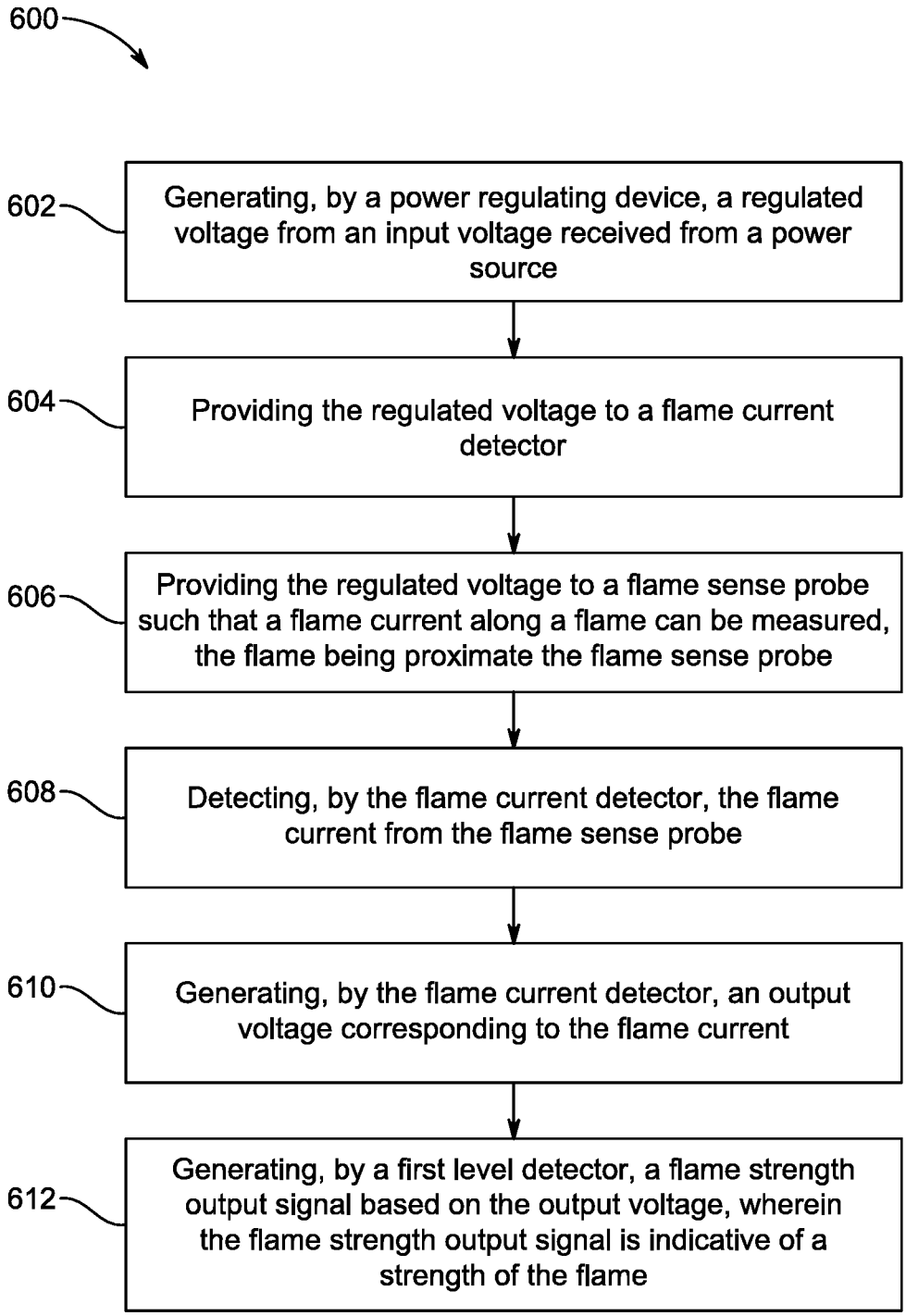
FIG. 6 is a flowchart of a method of sensing a flame.

FIG. 6 is a flowchart of a method 600 of sensing a flame. The method 600 is described in conjunction with the FIG. 1 and the FIG. 2. At step 602, the method 600 can include generating, by the power regulating device 202, a regulated voltage from an input voltage received from the power source 102. As an example, the power source 102 can be configured to supply 24 Volt AC line signal or 120 Volt AC line signal to the power regulating device 202.

At step 604, the method 600 can include providing the regulated voltage to the flame current detector 204. At step 606, the method 600 can include providing the regulated voltage to the flame sense probe 108 such that a flame current along a flame can be measured, with the flame being proximate the flame sense probe 108 (or supposed to be proximate the flame sense probe 108, if the flame is currently absent). The flame sense probe 108 can be shaped for sensing the flame efficiently. For example, the flame sense probe 108 can be shaped in cylindrical shape, cone shaped, flat circular shaped and the like, depending on a type of the flame or a type of burner. Further, the flame sense probe 108 material can be designed as a sheet, a mesh, a rod, a wire(s) and the like, ensuring the desired reception of the flame.

At step 608, the method 600 can include detecting, by the flame current detector 204, the flame current from the flame sense probe 108. At step 610, the method 600 can include generating, by the flame current detector 204, an output voltage corresponding to the flame current. The flame current detector 204 can identify a change in the flame current due to change in strength of the flame and can generate the output voltage corresponding to the change in the flame current.

At step 612, the method 600 can include generating, by the first level detector 206, a flame strength output signal based on the output voltage, wherein the flame strength output signal is indicative of a strength of the flame. The second level detector 208 can generate a flame presence output signal based on the output voltage, where the flame presence output signal is indicative of a presence or an absence of the flame at the flame sense probe 108. Further, a third level detector 210 can generate a diagnostic output signal based on the output voltage, where the diagnostic output signal is indicative of an operationality of the flame sensing system 100. Also, a peak level detector 212 generates an analog secondary flame strength output signal from the output voltage, where the analog secondary flame strength output signal provides an analog indication of a strength of the flame.

The present disclosure provides the flame sensing system 100 for flame sense and flame strength detection. The flame sensing system 100 can be used in personal or commercial heating appliances, such as gas water heaters, gas furnaces, and the like. The flame sensing system 100 (or a component therein, such as the flame sensing unit 104) can be incorporated into existing heating appliances. Alternatively or additionally, the flame sensing system 100 can be a part of heating appliances by default according to industry standards. Further, the flame sensing system 100 can be a self-diagnostic system. As an example, the flame sensing system 100 can monitor itself to ensure that its components, such as flame sensing device 106 and flame sense probe 108 are working as desired.

As described herein, the flame sensing system 100 can detect the flame in a safety-robust manner and can provide an indication of the flame quality. The flame sensing system 100 can operate at higher frequencies as compared to conventional flame sensing system, thus allowing faster response to changes in the flame current. Transformers of the conventional flame sensing systems typically operate at 60 Hertz, and the transformer of the flame sensing system 100 can operate at much higher frequencies, such as 500 Hertz. This can enable the flame sensing system 100 to acquire more information (about the flame) in shorter time by Nyquist criteria. For example, the flame sensing system 100 can be able to detect the presence of the flame in microseconds while the existing flame sensing systems are known to take 3 to 10 seconds to detect the presence of the flame.

Further, the regulated voltage generated by the power regulating device 202 of the flame sensing device 106 can be immune or less sensitive to fluctuations/variations in the input power. Since the power regulating device 202 includes a high frequency transformer, the size of required magnetics in the flame sensing system 100 is minimized. As a result, the flame sensing system 100 can be a compact and a cost-effective system. Also, since the regulated high voltage can be used for flame sense and flame strength detection, susceptibility to inconsistencies in detection of dynamic signals (i.e., detection levels) caused by fluctuations/variations in the input power cam be eliminated or substantially reduced. This can facilitate more precision and repeatability of output signals from the level detectors and can eliminate the need for the integrator/filter in the flame sensing system, as required by traditional systems. Also, eliminating susceptibility to inconsistencies in the input power can facilitate or enable use of the peak detector 212 for fast analog flame strength analysis. Further, based on the pulse width analysis of the dynamic signals, the flame sensing system 100 can be able to sense the flame and detect the flame strength accurately and efficiently.

While aspects of the present disclosure have been particularly shown and described with reference to the embodiments above, it will be understood by those skilled in the art that various additional embodiments may be contemplated by the modification of the disclosed methods without departing from the spirit and scope of what is disclosed. Such embodiments should be understood to fall within the scope of the present disclosure as determined based upon the claims and any equivalents thereof.

What is claimed is:

1. A flame sensing system comprising:

a flame sense probe;

a power regulating device electrically coupled to the flame sense probe and configured to:

generate a regulated voltage from an input voltage received from a power source; and output the regulated voltage to the flame sense probe as a dynamic signal having a substantially square or sinusoidal wave form at a frequency higher than 60 Hz and up to approximately 500 Hz;

a flame current detector electrically coupled to the power regulating device and the flame sense probe, the flame current detector configured to measure a flame current and generate an output voltage corresponding to the flame current;

a first level detector electrically coupled to the flame current detector, the first level detector configured to generate a flame strength output signal based on the output voltage, wherein the flame strength output signal is indicative of a strength of a flame located proximate the flame sense probe;

a second level detector electrically coupled to the flame current detector, the second level detector configured to generate a flame presence output signal based on comparison of the output voltage to a pre-determined presence threshold, wherein the flame presence output signal is indicative of a presence or an absence of the flame proximate the flame sense probe, and a processor electrically coupled to the first level detector and the second level detector and configured to concurrently receive the flame strength output signal from the first level detector and the flame presence output signal from the second level detector, wherein the second level detector has a different sensitivity characteristic than the first level detector so that the flame presence output signal is different from the flame strength output signal.

2. The flame sensing system of claim 1, wherein the power regulating device is configured to output the regulated voltage to the flame sense probe at a frequency higher than 400 Hz and up to approximately 500 Hz, and wherein the first level detector is configured to generate the flame strength output signal based on comparison of the output voltage to a pre-determined strength threshold.

3. The flame sensing system of claim 1, further comprising a third level detector configured to generate a diagnostic output signal based on comparison of the output voltage to a pre-determined diagnostic threshold level, wherein the diagnostic output signal is indicative of an operationality of the flame sensing system.

4. The flame sensing system of claim 3, wherein the processor is further electrically coupled to the third level detector, and wherein the processor is further configured to:

receive the diagnostic output signal from the third level detector;

monitor a change in the flame current, a change in the flame strength output signal, a change in the flame presence output signal, and/or a change in the diagnostic output signal; and generate a digital output indicative of working condition of the flame sensing device and/or a flame status indicative of the strength of the flame; and a display unit electrically coupled to the processor and configured to display the digital output.

5. The flame sensing system of claim 1, further comprising a peak detector configured to generate an analog secondary flame strength output signal based on the output voltage, wherein the analog secondary flame strength output signal provides an analog indication of the strength of the flame.

6. The flame sensing system of claim 1, wherein the power regulating device comprises a rectifier and a regulated inverter configured to generate the regulated voltage from the input voltage received from the power source and to output the flame current.

7. The flame sensing system of claim 3, wherein the third level detector has a different sensitivity characteristic than the first level detector and the second level detector so that the diagnostic output signal is different from the flame presence output signal and the flame strength output signal.

8. A flame sensing unit comprising:

a flame sense probe;

a flame sensing device comprising:

a power regulating device electrically coupled to the flame sense probe and configured to:

generate a regulated voltage from an input voltage received from a power source; and output the regulated voltage to the flame sense probe as a dynamic signal having a substantially square or sinusoidal wave form at a frequency higher than 60 Hz and up to approximately 500 Hz;

a flame current detector electrically coupled to the power regulating device and the flame sense probe, the flame current detector being configured to:

detect a flame current from the flame sense probe; and generate an output voltage corresponding to the flame current; and a first level detector electrically coupled to the flame current detector and configured to generate a flame strength output signal based on the output voltage;

a second level detector electrically coupled to the flame current detector and configured to generate a flame presence output signal based on a comparison of the output voltage to a pre-determined presence threshold; and a processor electrically coupled to the first level detector and the second level detector and configured to:

concurrently receive the flame strength output signal and the flame presence output signal; and generate an output indicative of a strength and either a presence or an absence of a flame located proximate the flame sense probe, wherein the second level detector has a different sensitivity characteristic than the first level detector so that the flame presence output signal is different from the flame strength output signal.

9. The flame sensing unit of claim 8, wherein the first level detector is configured to generate the flame strength output signal based on comparison of the output voltage to a pre-determined strength threshold.

10. The flame sensing unit of claim 8 further comprising a third level detector configured to generate a diagnostic output signal indicative of an operationality of the flame sensing unit.

11. The flame sensing unit of claim 10, wherein the third level detector has a different sensitivity characteristic than the first level detector and the second level detector so that the diagnostic output signal is different from the flame presence output signal and the flame strength output signal.

12. The flame sensing unit of claim 10, wherein the third level detector is configured to generate the diagnostic output signal based on comparison of the output voltage to a pre-determined diagnostic threshold.

13. The flame sensing unit of claim 8 further comprising a peak detector to generate an analog secondary flame strength output signal, wherein the analog secondary flame strength output signal provides an analog indication of a strength of the flame.

14. The flame sensing unit of claim 8, wherein the power regulating device comprises a rectifier and a regulated inverter to generate the regulated voltage from the input voltage and to output the regulated voltage.

15. A method of sensing a flame comprising:

generating, by a power regulating device, a regulated voltage from an input voltage received from a power source, wherein the power regulating device is configured to output the regulated voltage as a dynamic signal having a substantially square or sinusoidal wave form at a frequency higher than 60 Hz and up to approximately 500 Hz;

providing the regulated voltage to a flame current detector;

providing the regulated voltage to a flame sense probe such that a flame current along a flame can be measured, the flame being proximate the flame sense probe;

detecting, by the flame current detector, a flame current from the flame sense probe;

generating, by the flame current detector, an output voltage corresponding to the flame current;

generating, by a first level detector, a flame strength output signal based on the output voltage, wherein the flame strength output signal is indicative of a strength of the flame;

generating, by a second level detector, a flame presence output signal based on comparison of the output voltage to a pre-determined presence threshold, wherein the flame presence output signal is indicative of a presence or an absence of the flame at the flame sense probe;

receiving, by a processor, the flame strength output signal and the flame presence output signal, wherein the flame strength output signal and the flame presence output signal are concurrently received by the processor; and generating, by the processor, an output indicative of a strength and either a presence or an absence of a flame located proximate the flame sense probe, wherein the second level detector has a different sensitivity characteristic than the first level detector so that the flame presence output signal is different from the flame strength output signal.

16. The method of claim 15 further comprising:

identifying, by the flame current detector, a change in the flame current indicative of a change in the strength of the flame, wherein the output voltage corresponds to the change in the flame current.

17. The method of claim 15 further wherein the flame strength output signal is generated based on a comparison of the output voltage to a pre-determined strength threshold.

18. The method of claim 15 further comprising generating, by a third level detector, a diagnostic output signal based on comparison of the output voltage to a pre-determined diagnostic threshold, wherein the diagnostic output signal is indicative of an operationality of the flame sensing system.

19. The method of claim 15 further comprising generating, by a peak level detector, an analog secondary flame strength output signal based on the output voltage, wherein the analog secondary flame strength output signal provides an analog indication of the strength of the flame.

20. The method of claim 18, wherein the third level detector has a different sensitivity characteristic than the first level detector and the second level detector so that the diagnostic output signal that is generated is different from the flame presence output signal and the flame strength output signal.

* * * * *